US012808166B1

(12) United States Patent
Qian

(10) Patent No.: US 12,808,166 B1
(45) Date of Patent: Nov. 24, 2026

(54) CUP WASHER

(71) Applicant: Ruiguang Qian, Wenzhou (CN)

(72) Inventor: Ruiguang Qian, Wenzhou (CN)

( * ) Notice: Subject to any disclaimer, the term of this patent is extended or adjusted under 35 U.S.C. 154(b) by 0 days.

(21) Appl. No.: 19/538,975

(22) Filed: Feb. 12, 2026

(30) Foreign Application Priority Data

Dec. 26, 2025 (CN) ..... 202522776975.X

(51) Int. Cl.
*E03C 1/02* (2006.01)
*E03C 1/04* (2006.01)

(52) U.S. Cl.
CPC ..... *E03C 1/04* (2013.01); *E03C 1/023* (2013.01); *E03C 1/0404* (2013.01)

(58) Field of Classification Search
None
See application file for complete search history.

(56) References Cited

U.S. PATENT DOCUMENTS

2021/0052131 A1* 2/2021 Cipriani ..... A47L 17/00

* cited by examiner

*Primary Examiner* — Levon J Shahinian

(57) ABSTRACT

A cup washer includes a base, a trigger mechanism, and a water collection tray. The base defines a water inlet channel. The trigger mechanism is slidably mounted to the base and defines a water outlet channel and at least one water outlet communicated with the water outlet channel. The water collection tray is mounted to the trigger mechanism and arranged below the at least one water outlet. The water collection tray defines a drainage channel. Pressing the water collection tray drives the trigger mechanism to slide relative to the base, enabling the water outlet channel to be communicated with the water inlet channel.

16 Claims, 10 Drawing Sheets

CUP WASHER

CROSS REFERENCE TO RELATED APPLICATIONS

This application claims priority of the Chinese patent application No. 202522776975.X, filed on Dec. 26, 2025, the disclosure of which is hereby incorporated by reference in its entirety.

FIELD OF THE DISCLOSURE

The present disclosure relates to the technical field of cleaning utensils, in particular to a cup washer.

BACKGROUND

Existing cup washers generally include a base mounted on a sink, a water collection tray fixed on the base, and a trigger mechanism movable relative to the water collection tray. The trigger mechanism is equipped with a pressing plate or a pressing rod which is cooperated with a cup. This structure of the trigger mechanism is relatively complex, resulting in high manufacturing costs.

SUMMARY

The following presents a simplified summary of the disclosure in order to provide a basic understanding of some aspects of the disclosure. This summary is not an extensive overview of the disclosure. It is not intended to identify critical elements or to delineate the scope of the disclosure. Its sole purpose is to present some concepts of the disclosure in a simplified form as a prelude to the more detailed description that is presented elsewhere.

In some embodiments, a cup washer is provided. The cup washer includes a base, a trigger mechanism, and a water collection tray. The base defines a water inlet channel. The trigger mechanism is slidably mounted to the base and defines a water outlet channel and at least one water outlet communicated with the water outlet channel. The water collection tray is mounted to the trigger mechanism and arranged below the at least one water outlet. The water collection tray defines a drainage channel. Pressing the water collection tray drives the trigger mechanism to slide relative to the base, enabling the water outlet channel to be communicated with the water inlet channel.

BRIEF DESCRIPTION OF THE DRAWINGS

Illustrative embodiments of the present disclosure are described in detail below with reference to the attached drawing figures.

NUMERAL REFERENCE IN THE DRAWINGS

1—cup washer; 11—base; 12—trigger mechanism; 13—water collection tray; 14—elastic member; 15—limit bolt; 1101—water inlet channel; 1102—first end of the base; 1103—second end of the base; 1104—sleeve portion; 1105—sliding channel; 1106—first fixing member; 1107—second fixing member; 1201—water outlet channel; 1202—water outlet; 1301—drainage channel; 1302—mounting hole; 1303—water collection groove; 11051—first segment; 11052—second segment; 11053—water passage gap; 121—connection portion; 122—water outlet portion; 123—mounting member; 1211—water inlet; 1212—first blocking protrusion; 1213—second blocking protrusion; 1214—communication cavity; 1221—water outlet column; 1222—water outlet head; 1223—rotation member; 1224—water outlet cavity; 1225—steering force-receiving platform; 12251—pushing face; 12252—flow guiding face;

2—faucet; 20—water delivery channel; 21—fixing base; 22—faucet body; 23—water passage member; 211—first water passage; 221—second water passage; 231—third water passage; 232—water passage cavity.

DETAILED DESCRIPTION

The following describes some non-limiting exemplary embodiments of the disclosure with reference to the accompanying drawings. The described embodiments are merely a part rather than all of the embodiments of the disclosure. All other embodiments obtained by a person of ordinary skill in the art based on the embodiments of the disclosure shall fall within the scope of the disclosure.

Unless otherwise defined, all technical and scientific terms used herein have the same meaning as commonly understood by those skilled in the art to which the present disclosure belongs. The terms used in the description of the present disclosure herein are intended for describing particular embodiments only and are not intended to limit the present disclosure. In the description, claims, and the above drawings of the present disclosure, the terms "including" and "having", as well as their variants, are intended to convey a non-exclusive inclusion. The terms "first", "second", etc., as used herein, are intended to distinguish between different objects, rather than to describe a particular order.

Reference to "embodiments" herein implies that a particular feature, structure, or characteristic described in conjunction with an embodiment may be included in at least one embodiment of the present disclosure. The appearance of the phrase at various places in the specification does not necessarily refer to the same embodiment, nor is it a separate or an alternative embodiment that is mutually exclusive of other embodiments. One skilled in the art would explicitly and implicitly understand that the embodiments described herein can be combined with other embodiments.

Figure 7:
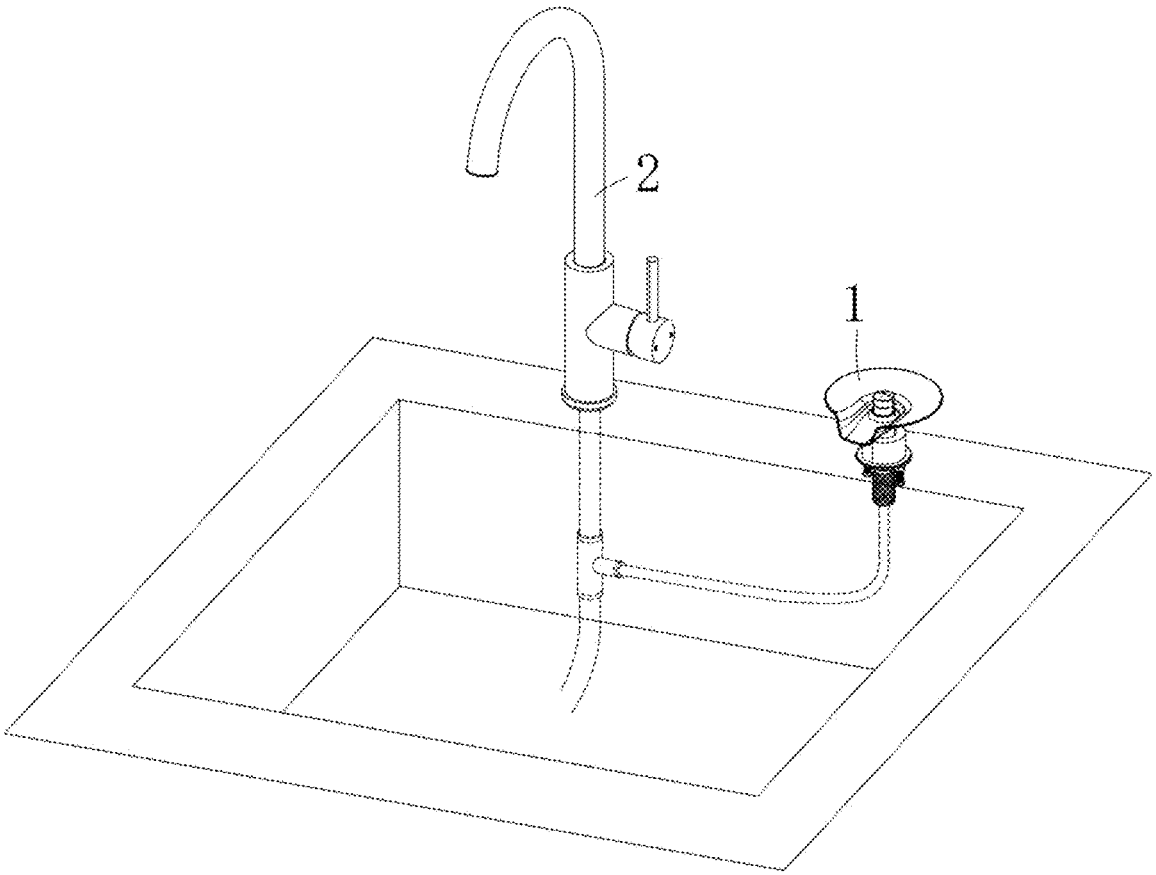
FIG. 7 is a schematic view of a cup washer mounted on a sink according to embodiments of the present disclosure, showing the cup washer communicated to a water inlet pipe of a faucet via a pipe.

Referring to FIGS. 1 to 10, the present disclosure provides a cup washer 1. The cup washer 1 may include a base 11, a trigger mechanism 12, and a water collection tray 13. The base 11 may be mounted on positions such as a washbasin, a sink, etc., and the base 11 may define a water inlet channel 1101. The water inlet channel 1101 of the base 11 may be directly communicated to an external water source for use, or as shown in FIG. 7, the water inlet channel 1101 may be communicated to a water inlet pipe of a faucet 2 via a pipe. The trigger mechanism 12 may be slidably mounted to the base 11, and the trigger mechanism 12 may define a water outlet channel 1201 and a water outlet 1202 communicated with the water outlet channel 1201. The water collection tray 13 may be mounted to the trigger mechanism 12, and the water collection tray 13 may be located below the water outlet 1202. The water collection tray 13 may define a drainage channel 1301.

A user can hold a cup, press a cup mouth of the cup on the water collection tray 13, press down the water collection tray 13, which can drive the trigger mechanism 12 to slide relative to the base 11, thereby enabling the water outlet channel 1201 to be communicated with the water inlet channel 1101, correspondingly causing water in the water inlet channel 1101 to jet out from the water outlet 1202 and perform a high-pressure rinsing on an inside of the cup. The rinsing water flows down along a cup body onto the water collection tray 13 and flows out through a drainage channel 1301 on the water collection tray 13. In addition, the cup washer 1 may be arranged with an elastic member 14. After the cup is cleaned, a downward force applied to the water collection tray 13 may be released, and the trigger mechanism 12 and the water collection tray 13 can be reset by an elastic force of the elastic member 14.

Therefore, the trigger mechanism 12 may be associated with the water collection tray 13 in the cup washer 1. The water collection tray 13 and the trigger mechanism 12 can move synchronously. The water collection tray 13 may serve as a functional component for driving the trigger mechanism 12, meaning that the user can trigger the trigger mechanism 12 simply by pressing the water collection tray 13, without needing an additional triggering functional component for the trigger mechanism 12. Meanwhile, the water collection tray 13 may retain original functions of collecting and draining water, making the cup washer 1 simple in structure and easy to use.

Figure 1:
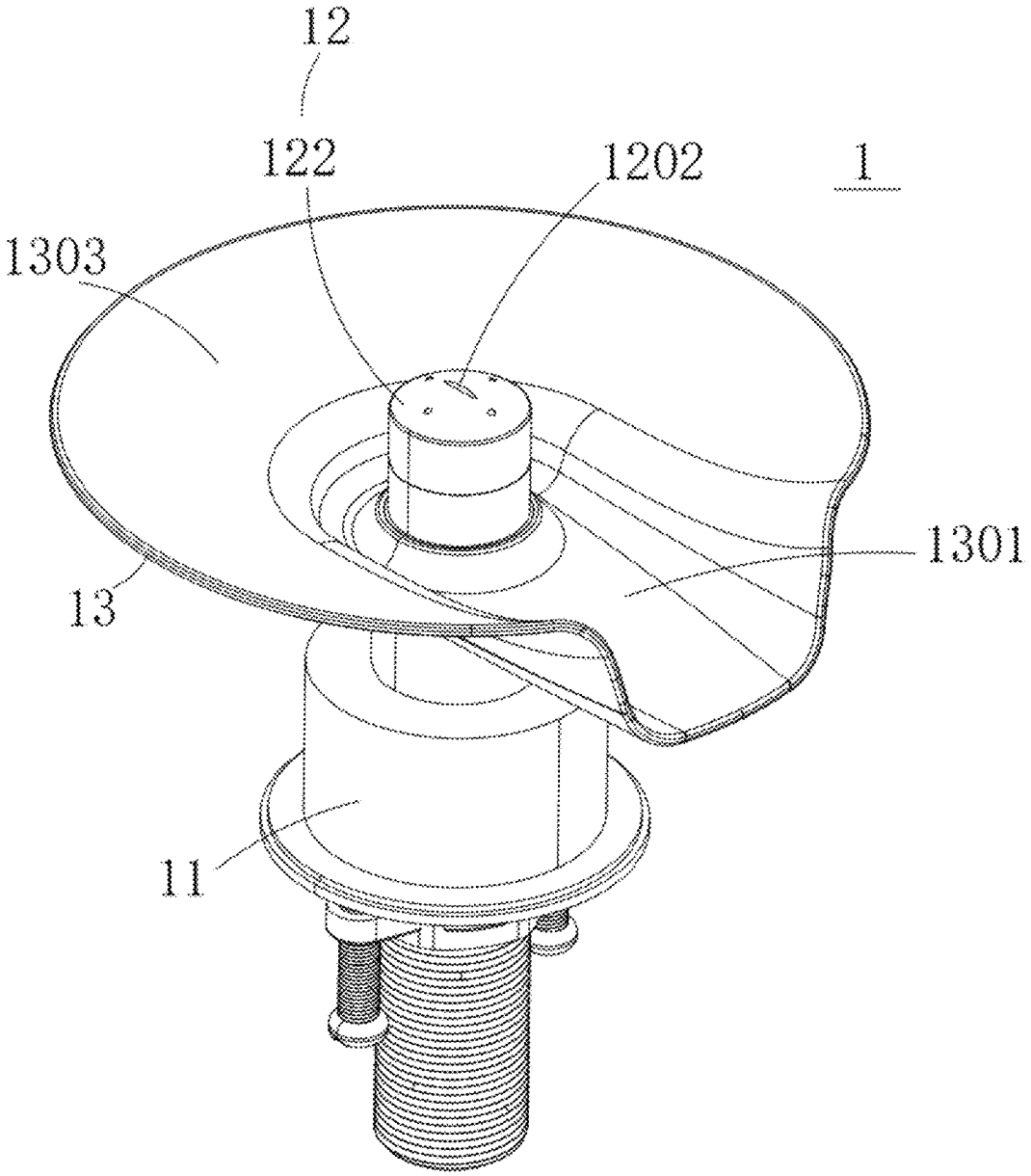
FIG. 1 is a schematic view of an overall structure of a cup washer according to embodiments of the present disclosure.
Figure 2:
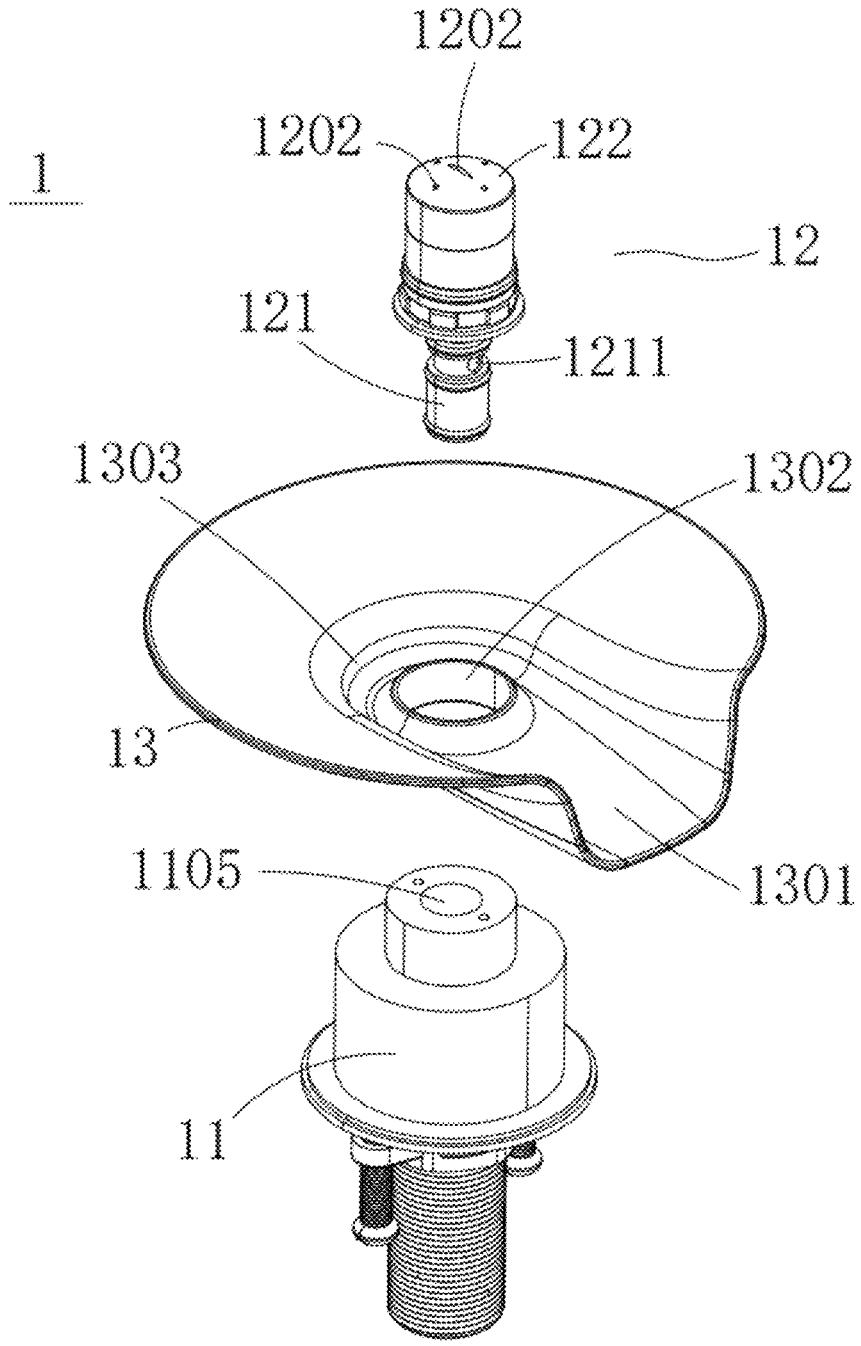
FIG. 2 is an exploded view of the cup washer according to embodiments of the present disclosure.
Figure 3:
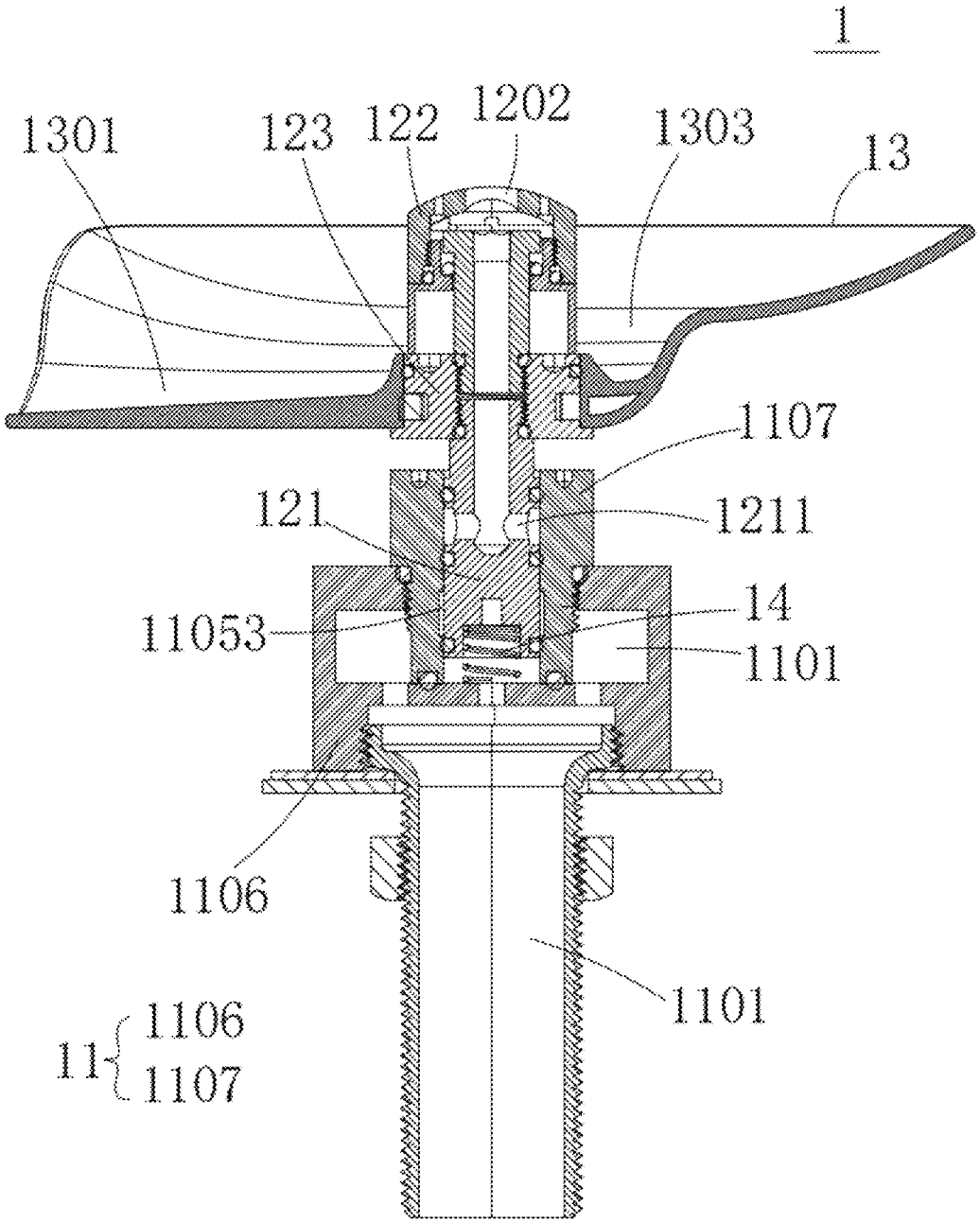
FIG. 3 is a cross-sectional view of the cup washer according to embodiments of the present disclosure, showing a connection portion in a second position.

Referring to FIGS. 2 and 3, in some embodiments, the trigger mechanism 12 may include a connection portion 121 and a water outlet portion 122. The connection portion 121 may be slidably mounted to the base 11. The water outlet 1202 may be formed on the water outlet portion 122. The water outlet channel 1201 may extend through the connection portion 121 and the water outlet portion 122. The water collection tray 13 may define a through mounting hole 1302. The water outlet portion 122 may pass through the mounting hole 1302, the water outlet 1202 is arranged above the water collection tray 13, and the water collection tray 13 is arranged between the connection portion 121 and the water outlet portion 122. The water collection tray 13 may be arranged surrounding the water outlet portion 122, so that the water collection tray 13 can completely receive a water flow falling after rinsing the cup, preventing water splashing.

In some embodiments, the water collection tray 13 may define a water collection groove 1303 converging towards the mounting hole 1302. The water collection groove 1303 may be generally funnel-shaped. A bottom portion of the water collection groove 1303 may be where the mounting hole 1302 is located. The drainage channel 1301 may extend from the mounting hole 1302 to an edge of the water collection tray 13. The water collection groove 1303 may guide water flow to the drainage channel 1301, and the water may then flow out along the drainage channel 1301 to be discharged at a designated location.

Figure 4:
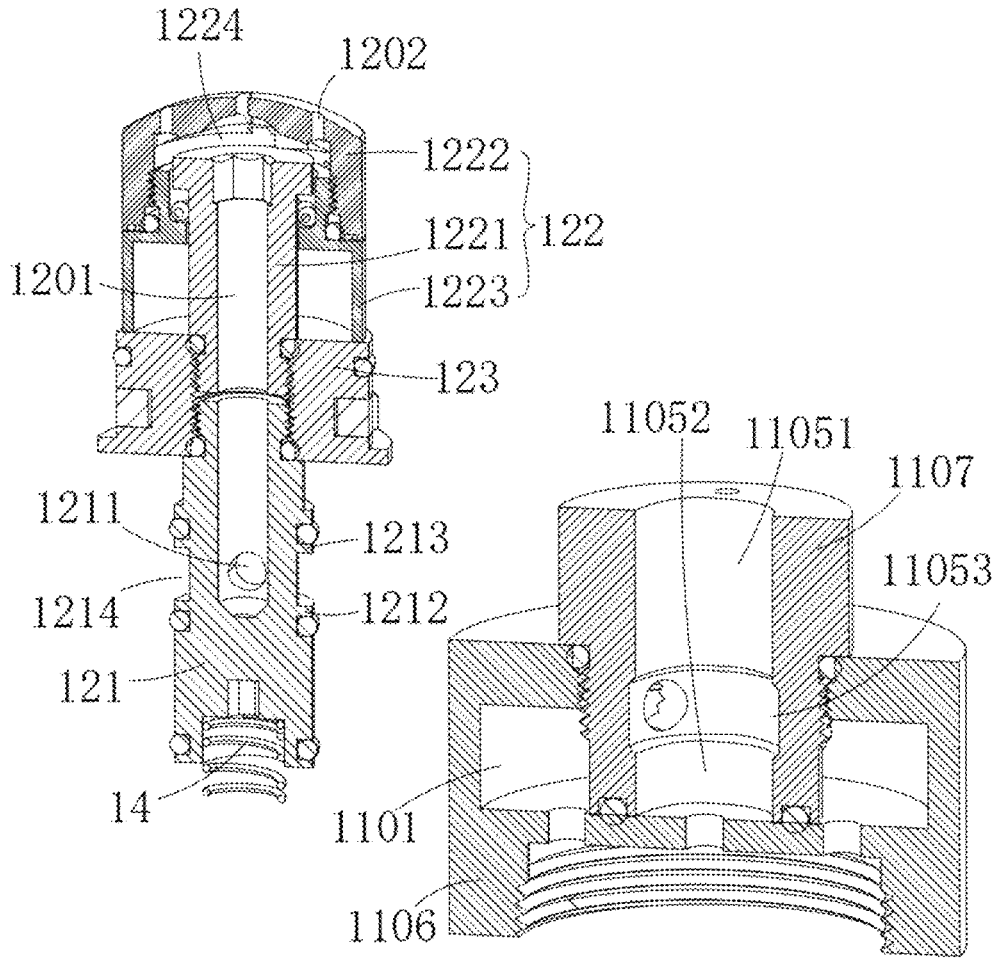
FIG. 4 is a schematic view of a connection structure between a trigger mechanism and a base of the cup washer according to embodiments of the present disclosure.
Figure 5:
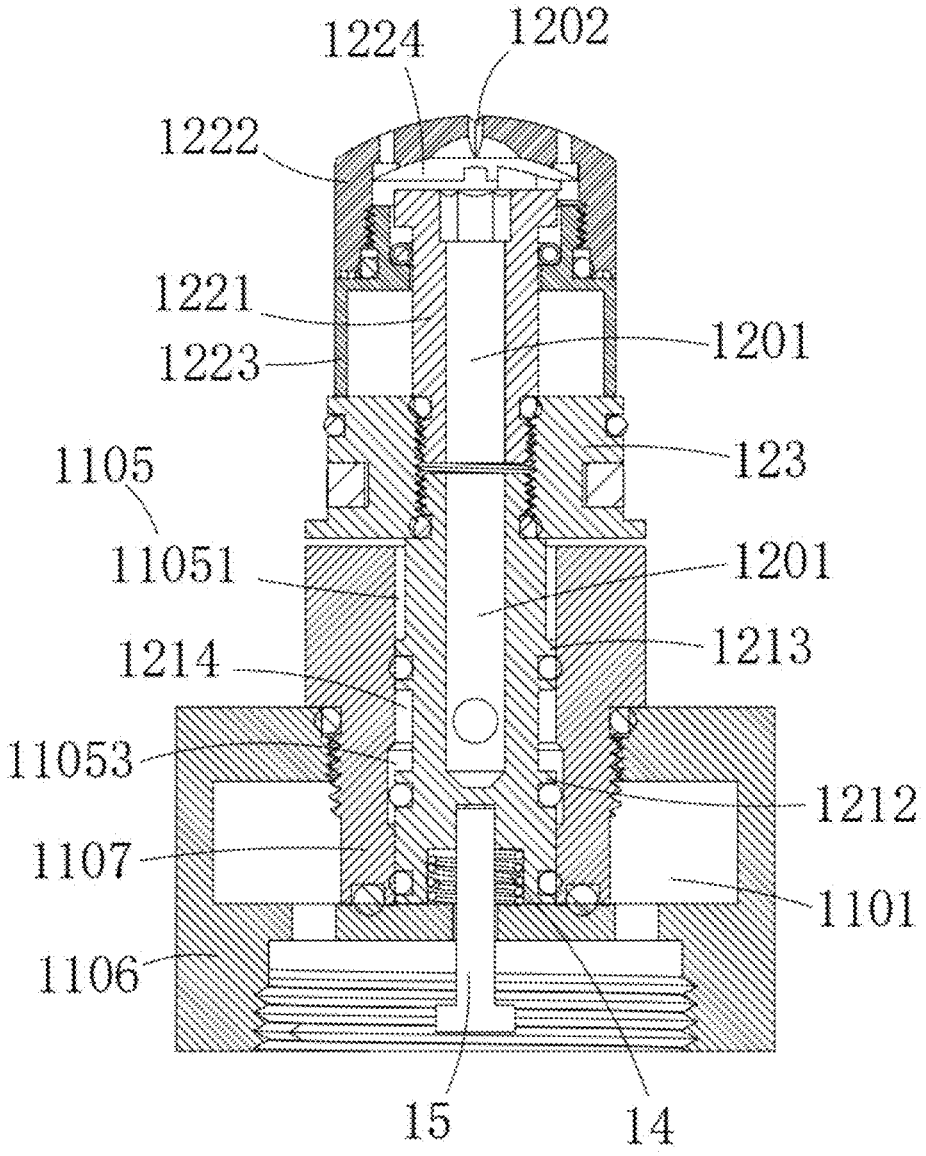
FIG. 5 is a schematic view when the connection portion is in a first position according to embodiments of the present disclosure.
Figure 6:
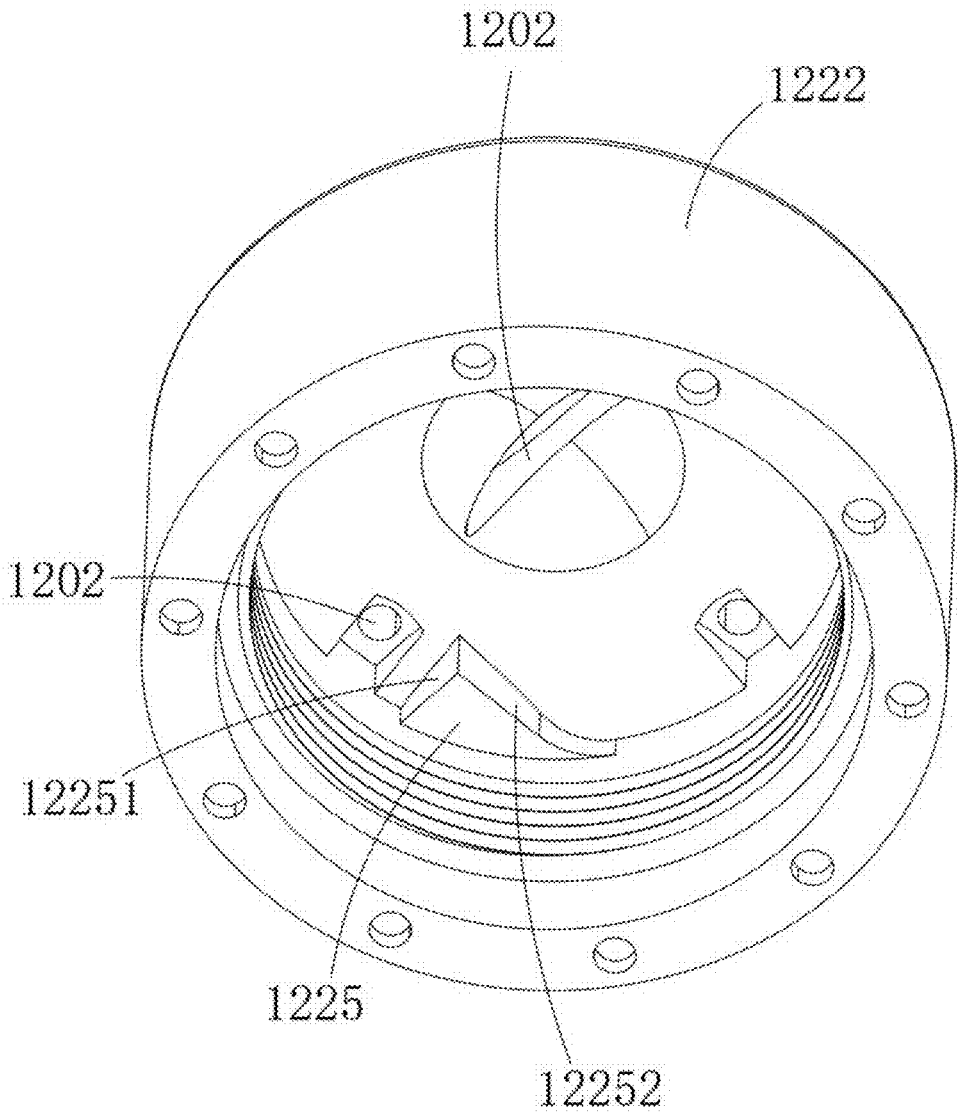
FIG. 6 is a structural view of a water outlet head according to embodiments of the present disclosure, showing a steering force-receiving platform.

Regarding the trigger mechanism 12, in some embodiments, referring to FIGS. 3 to 5, the connection portion 121 may define a water inlet 1211. The water outlet 1202 may be formed at a top portion of the water outlet portion 122. The water outlet channel 1201 may communicate the water outlet 1202 and the water inlet 1211. The connection portion 121 can slidably extend into the water inlet channel 1101, so that the water inlet 1211 may be communicated with the water inlet channel 1101 or out of communication with the water inlet channel 1101.

Specifically, the base 11 may define a sliding channel 1105 communicated with the water inlet channel 1101. The connection portion 121 may be arranged with a first blocking protrusion 1212 which may be circumferentially arranged. The connection portion 121 may slidably arranged in the sliding channel 1105, and may have a first position and a second position. FIG. 5 shows the connection portion 121 is in the first position. When the connection portion 121 is in the first position, the water inlet 1211 may be communicated to the water inlet channel 1101. FIG. 3 shows the connection portion 121 is in the second position. When the connection portion 121 is in the second position, the first blocking protrusion 1212 may closely abut an inner wall of the sliding channel 1105, so as to block a communication between the water inlet 1211 and the water inlet channel 1101. Correspondingly, the elastic member 14 may connect the connection portion 121 and the base 11. The elastic force of the elastic member 14 may move the connection portion 121 from the first position to the second position. When the user applies a pressure to the water collection tray 13, the connection portion 121 may be moved from the second position to the first position.

Furthermore, referring to FIGS. 3 to 5, the connection portion 121 may be further circumferentially arranged with a second blocking protrusion 1213 which may be annular. An outer diameter of the second blocking protrusion 1213 may be the same as an outer diameter of the first blocking protrusion 1212. A communication cavity 1214 may be formed between the first blocking protrusion 1212 and the second blocking protrusion 1213. The water inlet 1211 may communicate the communication cavity 1214 and the water outlet channel 1201. The sliding channel 1105 may include a first segment 11051 and a second segment 11052 which may be communicated with each other. A radius of the second segment 11052 may be greater than a radius of the first segment 11051. The first segment 11051 may communicate the second segment 11052 with an outside. A water passage gap 11053 may be formed between an inner wall of the second segment 11052 and the connection portion 121, which may remain in communication with the water inlet channel 1101.

When the connection portion 121 is in the first position, the first blocking protrusion 1212 may be located in the second segment 11052, enabling the communication cavity 1214 to be communicated to the water passage gap 11053, and water may jet out from the water outlet 1202. At this time, the second blocking protrusion 1213 may closely abut against an inner wall of the first segment 11051, so that the second blocking protrusion 1213 may block a communication between the communication cavity 1214 and the outside, that is, preventing water from the water inlet channel 1101 from flowing out to the outside through the communication cavity 1214 and the first segment 11051. When the connection portion 121 is in the second position, both the first blocking protrusion 1212 and the second blocking protrusion 1213 closely abut against the inner wall of the first segment 11051, so as to block the communication between the communication cavity 1214 and the second segment 11052 and the outside. At this time, water may stop flowing from the water outlet 1202. Of course, each of the first blocking protrusion 1212 and second blocking protrusion 1213 may be used in conjunction with a sealing ring to improve a sealing performance.

Correspondingly, as shown in FIGS. 4 and 5, the base 11 may be formed by a first fixing member 1106 and a second fixing member 1107. The water inlet channel 1101 may be formed in the first fixing member 1106. The sliding channel 1105 may be formed in the second fixing member 1107. The first fixing member 1106 and the second fixing member 1107 may be fixed to each other in a threaded connection. The elastic member 14 may be arranged in the second segment 11052 and abut against the connection portion 121 and the first fixing member 1106, as shown in FIG. 5.

In some embodiments, the water outlet portion 122 may define a plurality of water outlets 1202 of different shapes, such as narrow and long shaped, round hole shaped water outlets, for providing a plurality of water outlet modes.

Specifically, in some embodiments, referring to FIGS. 3 to 5, the water outlet portion 122 may include a water outlet column 1221 and a water outlet head 1222. The water outlet channel 1201 may extend through the water outlet column 1221. The water outlet head 1222 may be detachably connected to the water outlet column 1221, and the water outlet 1202 may be formed on the water outlet head 1222. Each water outlet head 1222 may correspondingly define one shape of water outlet 1202. Switching the water outlet mode can be achieved by replacing the water outlet head 1222.

Furthermore, the water outlet head 1222 may be enabled to rotate, so that when water jets out from the water outlet 1202, the water outlet head 1222 can clean the inside of the cup in all directions. Specifically, the water outlet portion 122 may further include a rotation member 1223. The rotation member 1223 may be rotatably mounted to the water outlet column 1221. The water outlet head 1222 may be threadedly connected to the rotation member 1223. The water outlet head 1222 can rotate together with the rotation member 1223 relative to the water outlet column 1221, so that the water outlet head 1222 may be indirectly connected to the water outlet column 1221 via the rotation member 1223.

A water outlet cavity 1224 which may be narrow may be formed between the water outlet head 1222 and the water outlet column 1221. Each of the water outlet channel 1201 and the water outlet 1202 may be communicated with the water outlet cavity 1224. A water pressure inside the water outlet cavity 1224 may be high, and cooperating with the narrow water outlet cavity 1224 may easily generate a vortex, providing a rotating force for the water outlet head 1222. Correspondingly, the water outlet head 1222 may be arranged with a steering force-receiving platform 1225 in the water outlet cavity 1224. The steering force-receiving platform 1225 may have a pushing face 12251 and a flow guiding face 12252. The flow guiding face 12252 may be used to guide a direction of the generated vortex, while the pushing face 12251 may bear an impact force of the water flow, thereby driving the water outlet head 1222 to rotate. In some embodiment, the water outlet 1202 may be formed in front of the pushing face 12251.

Regarding a relative rotation structure between the rotation member 1223 and the water outlet column 1221, specifically, referring to FIG. 3, the trigger mechanism 12 may further include a mounting member 123. Each of the water outlet column 1221 and the connection portion 121 may be threadedly connected to the mounting member 123, and the water collection tray 13 may be also mounted on the mounting member 123. The water outlet column 1221 may pass through the rotation member 1223 first, and may then be threadedly connected to the mounting member 123, enabling mounting and positioning of the rotation member 1223 to be achieved.

To prevent pulling the water collection tray 13 from causing the entire connection portion 121 to detach from the base 11, as shown in FIG. 5, a limit bolt 15 of an appropriate length may be arranged. The limit bolt 15 may pass through the first fixing member 1106 of the base 11 and extend into the second segment 11052 and may be fixed to the connection portion 121. The elastic member 14 may be a compression spring, which may be sleeved on the limit bolt 15.

Figure 8:
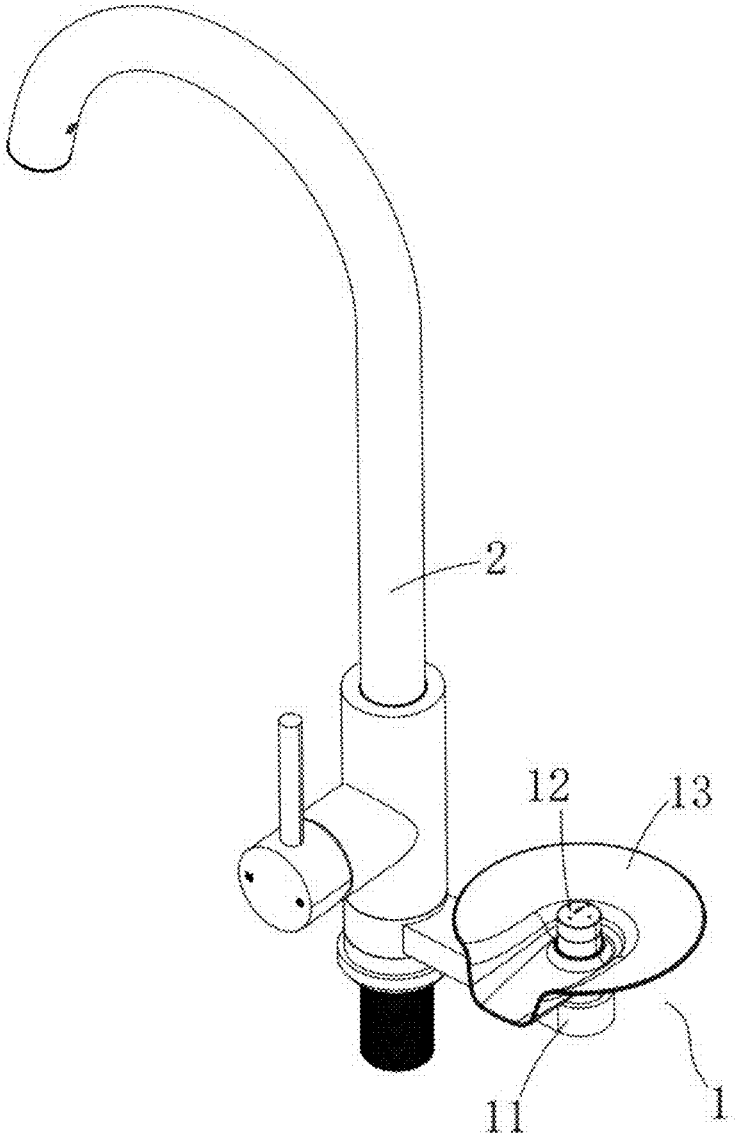
FIG. 8 is a structural view of a water outlet device according to embodiments of the present disclosure, showing the cup washer rotatably mounted to the faucet.
Figure 9:
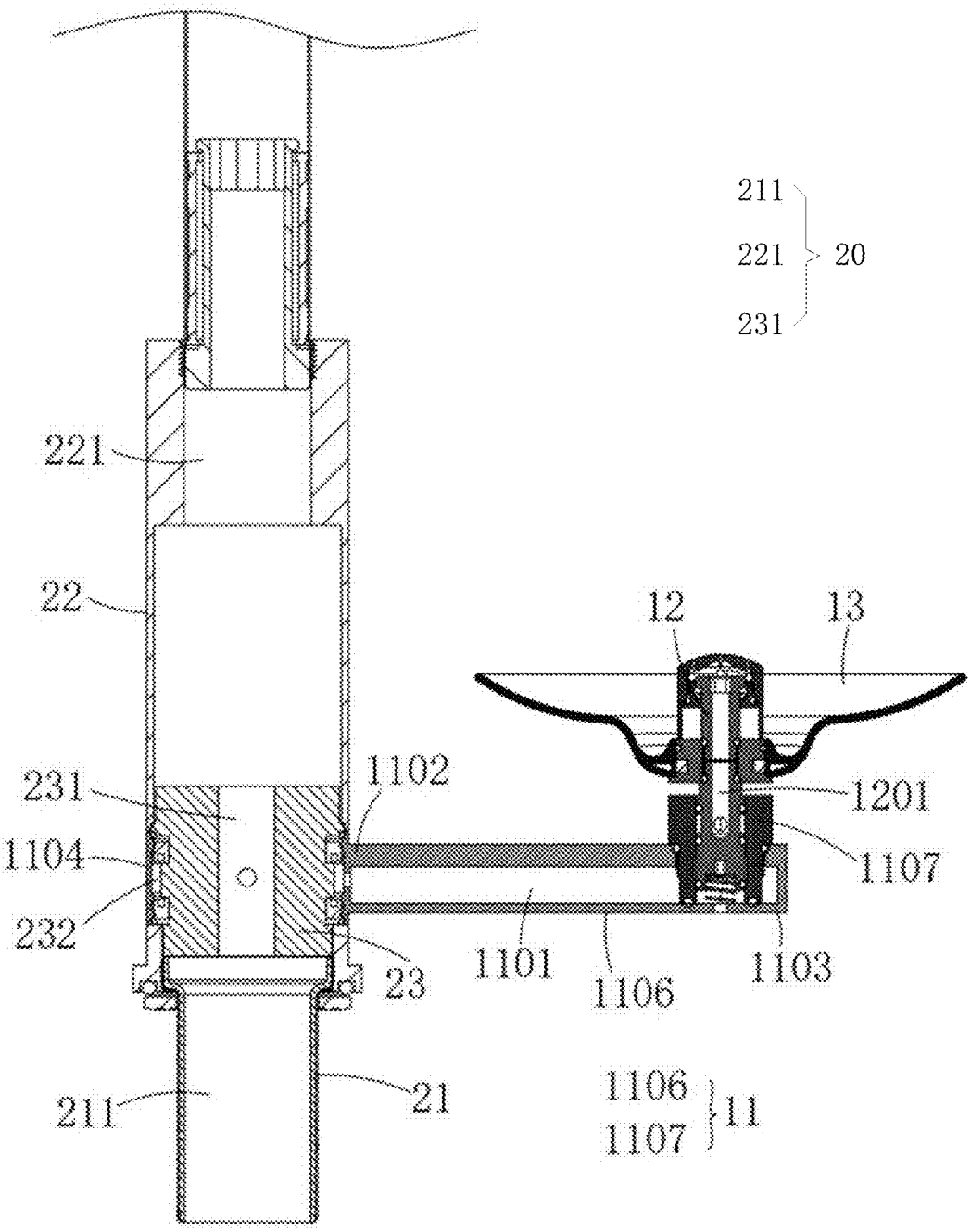
FIG. 9 is a cross-sectional view of the water outlet device according to embodiments of the present disclosure.
Figure 10:
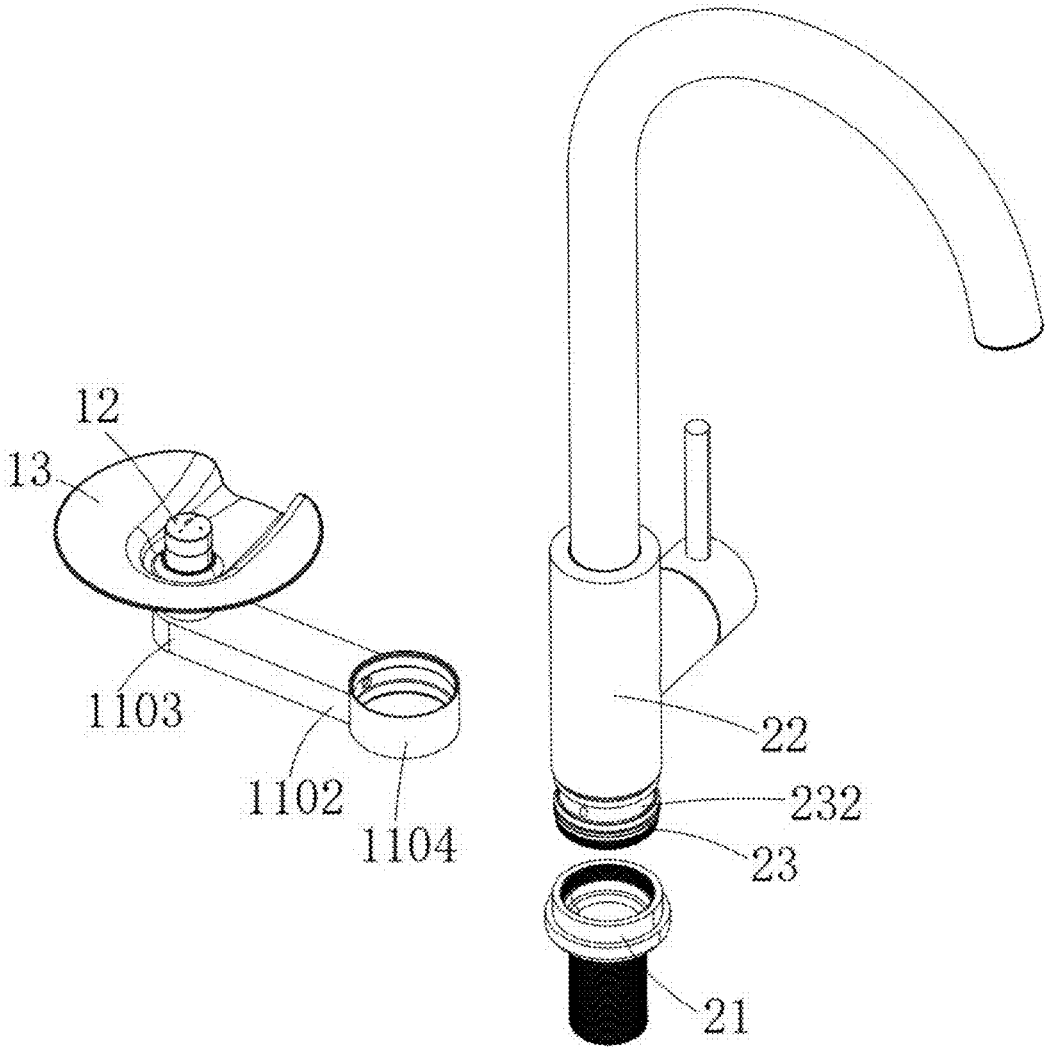
FIG. 10 is an exploded view of the water outlet device according to embodiments of the present disclosure.

In addition, referring to FIGS. 8 to 10, the present disclosure also provides a water outlet device, which may include the cup washer 1 and a faucet 2. In some embodiments, the base 11 of the cup washer 1 may be adaptively adjusted so that the base 11 may be directly connected to the faucet 2, while structures of the trigger mechanism 12 and the water collection tray 13 may be equivalent to those shown in FIGS. 1 to 6. Specifically, the faucet 2 may internally define a water delivery channel 20. A water delivery channel 20 may be directly connected to an external water source, and the water inlet channel 1101 of the base 11 may be connected to the water delivery channel 20.

In some embodiments, the base 11 may be fixedly connected to the faucet 2, or the first fixing member 1106 of the base 11 may be integrally formed with the faucet 2 as a one-piece structure.

In some embodiments, a first end 1102 of the base 11 may be rotatably mounted on the faucet 2, and a second end 1103 of the base 11 may be connected to the trigger mechanism 12. Specifically, the faucet 2 may include a fixing base 21, a faucet body 22, and a water passage member 23. The fixing base 21 may define a first water passage 211. The faucet body 22 may define a second water passage 221. The water passage member 23 may define a third water passage 231. The first water passage 211, the second water passage 221, and the third water passage 231 may cooperatively form the water delivery channel 20. The faucet body 22 may be mounted on the water passage member 23, and the water passage member 23 may be detachably connected to the fixing base 21, so that the third water passage 231 may communicate the first water passage 211 and the second water passage 221. The first end 1102 of the base 11 may be arranged with a sleeve portion 1104. The sleeve portion 1104 may sleeve the water passage member 23 and may be arranged to surround the water passage member 23, and the sleeve portion 1104 may be sandwiched between the fixing base 21 and the faucet body 22. A water passage cavity 232 may be formed between the sleeve portion 1104 and the water passage member 23. The third water passage 231 may be communicated to the water passage cavity 232, and the water inlet channel 1101 may be communicated to the water passage cavity 232, thereby allowing water flow in the third water passage 231 to enter the water inlet channel 1101 via the water passage cavity 232.

In these embodiments, similarly, the first fixing member 1106 may be connected to the faucet 2, and the second fixing member 1107 may be connected to the trigger mechanism 12.

The base 11 can rotate relative to the faucet 2, thereby adjusting a position of the water collection tray 13 according to a mounting position of the faucet 2, so that the drainage channel 1301 may be located above the sink. Or when the cup washer 1 is not in use, the water collection tray 13 may be moved outside a range of the sink; when the cup washer 1 needs to be used, the base 11 may be rotated so that the water collection tray 13 may be located above the sink.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Unless indicated otherwise, not all steps listed in the various figures need be carried out in the specific order described.

What is claimed is:

1. A cup washer, comprising:

a base, defining a water inlet channel;

a trigger mechanism, movably mounted to the base, and defining a water outlet channel and at least one water outlet communicated with the water outlet channel; and a water collection tray, mounted to the trigger mechanism, arranged below the at least one water outlet, and defining a drainage channel;

wherein pressing the water collection tray drives the trigger mechanism to slide relative to the base, enabling the water outlet channel to be communicated with the water inlet channel;

wherein the trigger mechanism comprises a connection portion and a water outlet portion, the connection portion defines a water inlet, the at least one water outlet is formed at a top portion of the water outlet portion, and the water outlet channel communicates the at least one water outlet with the water inlet;

the connection portion is movable within the water inlet channel to enable the water inlet to be communicated with the water inlet channel or to be out of communication with the water inlet channel;

the water outlet portion partially passes through the water collection tray, enabling the water outlet to be arranged above the water collection tray.

2. The cup washer according to claim 1, wherein the trigger mechanism comprises a connection portion and a water outlet portion, the connection portion is movably mounted to the base, and the at least one water outlet is formed on the water outlet portion;

the water collection tray defines a mounting hole penetrating the water collection tray, the water outlet portion partially passes through the mounting hole, enabling the water collection tray to surround the water outlet portion.

3. The cup washer according to claim 2, wherein the water collection tray defines a water collection groove converging towards the mounting hole, and the drainage channel extends from the mounting hole to an edge of the water collection tray.

4. The cup washer according to claim 2, wherein the number of the at least one water outlet is more than one, the more than one water outlet is formed on the water outlet portion, and a shape of one of the more than one water outlet is different from a shape of another one of the more than one water outlet.

5. The cup washer according to claim 2, wherein the water outlet portion comprises a water outlet column and a water outlet head, the water outlet channel extends to the water outlet column, the water outlet head is rotatably mounted on the water outlet column, and the at least one water outlet is formed on the water outlet head.

6. The cup washer according to claim 5, wherein the water outlet head is detachably connected to the water outlet column.

7. The cup washer according to claim 6, wherein the water outlet portion further comprises a rotation member, the rotation member is rotatably mounted to the water outlet column, the water outlet head is threadedly connected to the rotation member, enabling the water outlet head to be detachably connected to the water outlet column via the rotation member.

8. The cup washer according to claim 7, wherein a water outlet cavity is formed between the water outlet head and the water outlet column, each of the water outlet channel and the water outlet is communicated with the water outlet cavity, and the water outlet head is arranged with a steering force-receiving platform in the water outlet cavity.

9. The cup washer according to claim 1, wherein the base defines a sliding channel communicated with the water inlet channel, the connection portion is arranged with a first blocking protrusion, and the connection portion is movably arranged in the sliding channel and has a first position and a second position;

when the connection portion is in the first position, the water inlet is communicated to the water inlet channel; when the connection portion is in the second position, the first blocking protrusion closely abuts against an inner wall of the sliding channel, preventing the water inlet to be communicated with the water inlet channel.

10. The cup washer according to claim 9, further comprising an elastic member, wherein the elastic member connects the connection portion and the base, and an elastic force of the elastic member is configured to move the connection portion from the first position to the second position.

11. The cup washer according to claim 9, wherein the connection portion is further arranged with a second blocking protrusion, a communication cavity is formed between the first blocking protrusion and the second blocking protrusion, and the water inlet communicates the communication cavity with the water outlet channel;

the sliding channel comprises a first segment and a second segment, a radius of the second segment is greater than a radius of the first segment, the first segment communicates the second segment and an outside, and the second segment is communicated to the water inlet channel;

when the connection portion is in the first position, the first blocking protrusion is arranged in the second segment, and the second blocking protrusion closely abuts against an inner wall of the first segment, enabling the communication cavity and the second segment to be communicated with each other, and preventing the communication cavity to be communicated with the outside;

when the connection portion is in the second position, each of the first blocking protrusion and the second blocking protrusion closely abuts against the inner wall of the first segment, preventing the communication cavity to be communicated with the second segment and the outside.

12. The cup washer according to claim 1, wherein the number of the at least one water outlet is more than one, the more than one water outlet is formed on the water outlet portion, and a shape of one of the more than one water outlet is different from a shape of another one of the more than one water outlet.

13. The cup washer according to claim 1, wherein the water outlet portion comprises a water outlet column and a water outlet head, the water outlet channel extends to the water outlet column, the water outlet head is rotatably mounted on the water outlet column, and the at least one water outlet is formed on the water outlet head.

14. The cup washer according to claim 13, wherein the water outlet head is detachably connected to the water outlet column.

15. The cup washer according to claim 14, wherein the water outlet portion further comprises a rotation member, the rotation member is rotatably mounted to the water outlet column, the water outlet head is threadedly connected to the rotation member, enabling the water outlet head to be detachably connected to the water outlet column via the rotation member.

16. The cup washer according to claim 15, wherein a water outlet cavity is formed between the water outlet head and the water outlet column, each of the water outlet channel and the water outlet is communicated with the water outlet cavity, and the water outlet head is arranged with a steering force-receiving platform in the water outlet cavity.

* * * * *